US006880902B2

(12) United States Patent
Zimmerman

(10) Patent No.: US 6,880,902 B2
(45) Date of Patent: Apr. 19, 2005

(54) FLEXIBLE STORAGE UNIT FOR REFRIGERATOR

(75) Inventor: Robert C. Zimmerman, Elmwood, IL (US)

(73) Assignee: Maytag Corporation, Newton, IA (US)

( * ) Notice: Subject to any disclaimer, the term of this patent is extended or adjusted under 35 U.S.C. 154(b) by 41 days.

(21) Appl. No.: 10/385,610

(22) Filed: Mar. 12, 2003

(65) Prior Publication Data

US 2004/0178709 A1 Sep. 16, 2004

(51) Int. Cl.[7] ..... A47B 96/04
(52) U.S. Cl. ..... 312/404; 312/408; 312/351
(58) Field of Search ..... 312/401, 404, 312/408, 410, 351; 211/118

(56) References Cited

U.S. PATENT DOCUMENTS

| | | | |
|---|---|---|---|
| 1,771,782 A | 7/1930 | Gese | |
| 2,057,544 A | 10/1936 | Stratton | |
| 2,168,520 A | 8/1939 | Fregeau | |
| 2,586,225 A | 2/1952 | Hartman | |
| 3,938,872 A | 2/1976 | Hagerman | |
| 4,664,266 A | 5/1987 | Fausett et al. | |
| 5,114,019 A | 5/1992 | Sandbank | |
| 6,065,821 A | 5/2000 | Anderson et al. | |
| 6,220,465 B1 | 4/2001 | Jones | |
| 2003/0052583 A1 * | 3/2003 | Son | 312/404 X |

FOREIGN PATENT DOCUMENTS

| | | |
|---|---|---|
| JP | 408049963 A | 2/1996 |
| JP | 411044483 A | 2/1999 |

* cited by examiner

*Primary Examiner*—Anthony D. Barfield
(74) *Attorney, Agent, or Firm*—Diederiks & Whitelaw, PLC

(57) ABSTRACT

A storage unit for a refrigerator includes a flexible support made of nylon, wire, or any other similar flexible material. The storage unit includes a load support zone which varies in shape depending upon items placed thereon. Most preferably, at least the load support zone is constituted by a mesh which permits the flow of cooling air through the storage unit. The storage unit includes at least one attachment element for securing the flexible support directly to a refrigerator shelf and/or a liner of the refrigerator. The storage unit can be releasably attached or can be a permanent, but collapsible, fixture within the refrigerator.

20 Claims, 3 Drawing Sheets

FLEXIBLE STORAGE UNIT FOR REFRIGERATOR

BACKGROUND OF THE INVENTION

1. Field of the Invention

The present invention pertains to the art of refrigerators and, more particularly, to a flexible storage unit for a refrigerator.

2. Discussion of the Prior Art

It is common in the art of refrigerators to provide vertically adjustable storage units, such as shelves. Typical adjustable storage units include elongated, vertically extending and laterally spaced rails mounted on the rear wall of a refrigerator cabinet, with the rails enabling planar shelving units to be supported in selected vertically adjustable positions in a cantilevered manner. Although the vertically adjustable nature of the shelving units allows for some flexibility in product placement and storage within a refrigerator, problems still exist with regards to utilizing refrigerator space in an efficient and practical manner. Irregular shaped or round items can pose a problem from a storage standpoint, as can unusually large or small items.

For example, the space between a lower shelving unit and an upper shelving unit may be adjusted to accommodate the tallest item on the lower shelving unit. This leaves a headspace above the remaining shorter items, resulting in the inefficient use of storage space. Additionally, if the vertical space between shelving units is adjusted to the shortest items, a users access to the items located towards the back of the refrigerator and sandwiched between the shelving units becomes restricted. Further, the difficulty in stacking irregular shaped or round items, mainly due to their potential to roll off a shelving unit, makes them difficult to store efficiently. Although storage bins are often used to hold these types of items. However, a user may want to store an item within easy view, which would otherwise be hidden or obscured in a storage bin. Based on the above, there exists a need in the art of refrigerators for a storage unit that has the flexibility to be utilized for variously sized and shaped wherein the items can be displayed and stored in an efficient and accessible manner.

SUMMARY OF THE INVENTION

The present invention is directed to a storage arrangement for a refrigerator. In connection with a preferred embodiment of the invention, the refrigerator includes a cabinet shell within which is mounted at least one liner that defines a refrigeration compartment. A shelving system for the refrigeration compartment includes multiple, vertically spaced planar shelving members, as well as a flexible mesh storage unit. The flexible nature of the storage unit functions to automatically configures the storage unit to conform to the particular items stored thereon. Therefore, in addition to the planar shelving members which have predefined shapes, the flexible storage unit takes on a shape which depends on the shape of the supported item(s).

In accordance with the most preferred embodiment of the invention, the flexible storage unit includes a flexible mesh support having a load support zone and an attachment arrangement for securing the mesh support within the refrigerator. The mesh support can be suspended from one of the planar shelf members and/or connected to portions of the liner defining the refrigeration compartment.

Additional objects, features and advantages of the present invention will become more readily apparent from the following detailed description of preferred embodiments when taken in conjunction with the drawings wherein like reference numerals refer to corresponding parts in the several views.

DETAILED DESCRIPTION OF THE PREFERRED EMBODIMENTS

Figure 1:
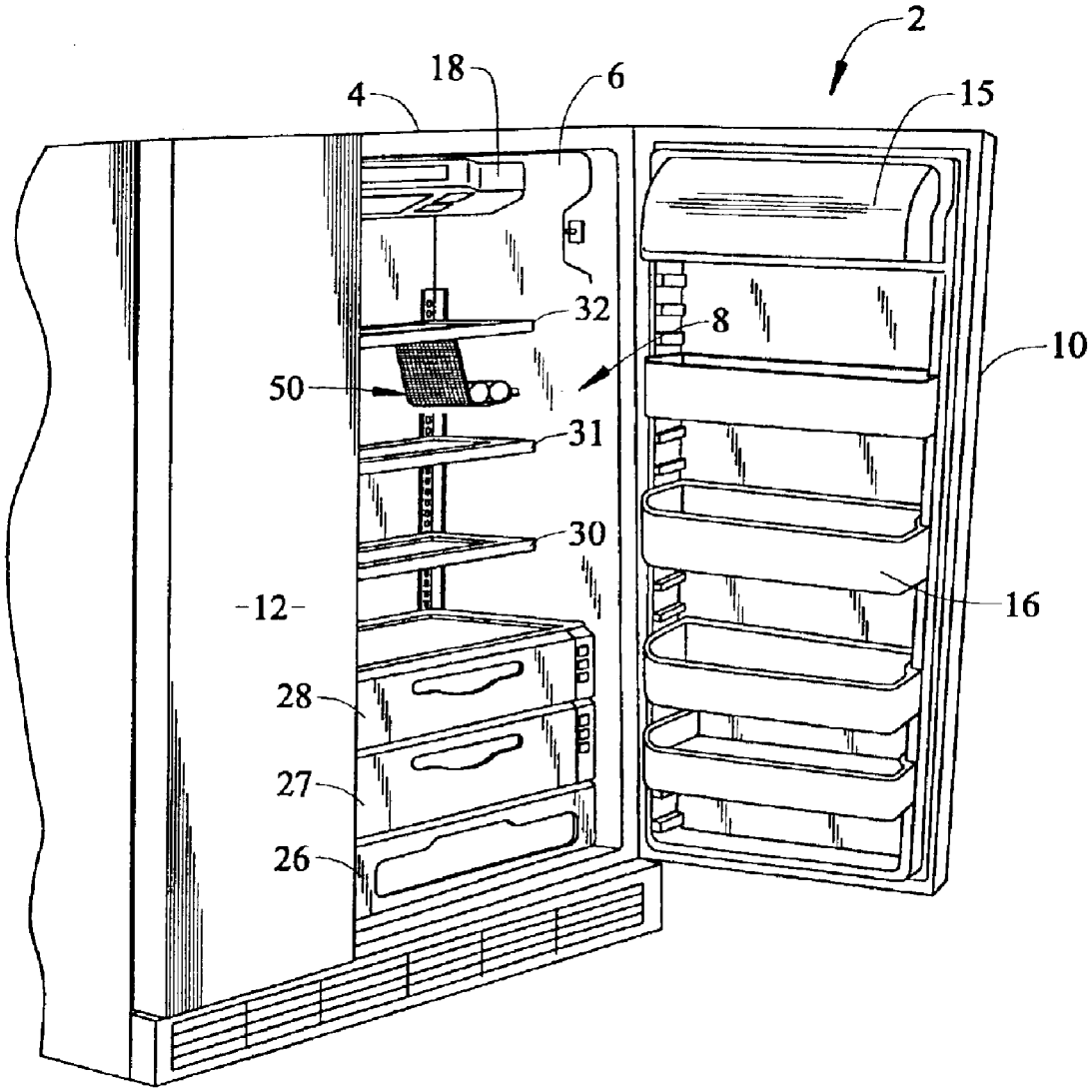
FIG. 1 is a partial perspective view of a side-by-side refrigerator incorporating a flexible storage unit constructed in accordance with a first embodiment of the invention.

With initial reference to FIG. 1, a refrigerator 2 is shown to include a cabinet shell 4 within which is positioned a liner 6 that defines a fresh food compartment 8. In a manner known in the art, fresh food compartment 8 can be accessed by the selective opening of fresh food door 10. In a similar manner, a freezer door 12 can be opened to access a liner defined freezer compartment (not shown). For the sake of completeness, door 10 of refrigerator 2 is shown to include dairy compartment 15 and various vertically adjustable shelving units, one of which is indicated at 16. Mounted in an upper region of fresh food compartment 8 is a temperature control housing 18 which, in a manner known in the art, can be used to regulate the temperature in both fresh food compartment 8 and the freezer compartment. At a lowermost portion of fresh food compartment 8 is illustrated various slidable bins, i.e., a lowermost bin 26 and higher, individually temperature controlled bins 27 and 28. Additionally, various vertically adjustable planar shelf members 30, 31 and 32 are spaced above bins 26, 27, and 28 in fresh food compartment 8.

To this point, the above-described structure is known in the art and presented only for the sake of completeness. This structure is more fully described in U.S. Pat. No. 6,170,276, which is incorporated herein by reference. The present invention is actually directed to a removable, flexible storage unit, one embodiment of which is generally indicated at 50 in FIG. 1, as will be detailed fully below.

Figure 2:
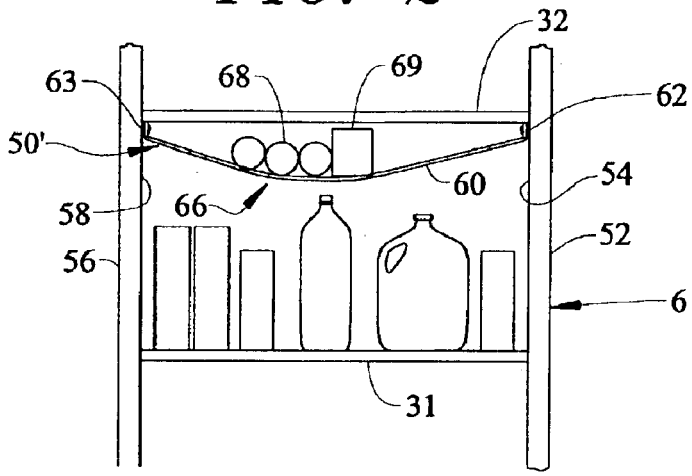
FIG. 2 is a front plan view of a refrigeration compartment storage arrangement incorporating a flexible storage unit constructed and mounted in accordance with a second embodiment of the invention.
Figure 3:
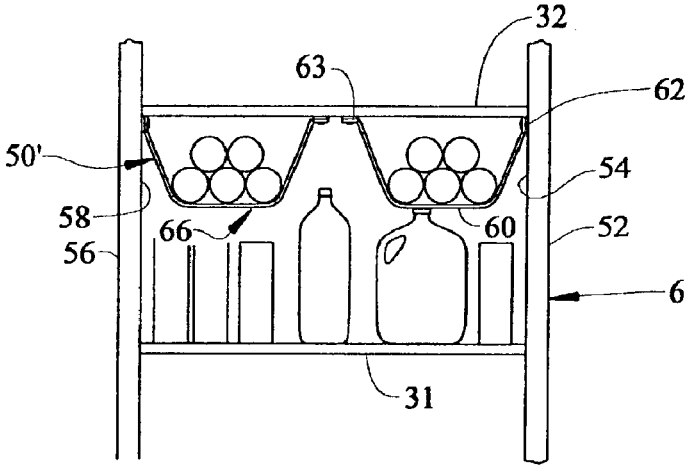
FIG. 3 is a front plan view of a refrigeration compartment storage arrangement incorporating a flexible storage unit constructed and mounted in accordance with a third embodiment of the invention.
Figure 4:
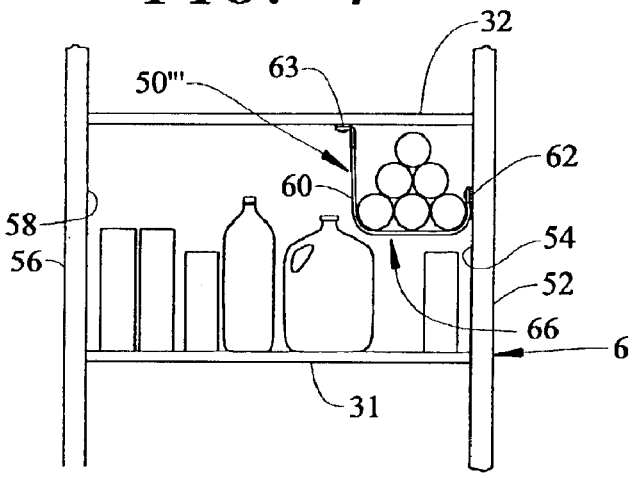
FIG. 4 is a front plan view of a refrigeration compartment storage arrangement incorporating a flexible storage unit constructed and mounted in accordance with a fourth embodiment of the invention.

Reference will now be made to FIGS. 2, 3 and 4 in describing additional preferred embodiments of the flexible storage unit of the present invention. As illustrated in FIG. 2, liner 6 has a first side wall 52 defining a first liner surface 54, and a second side wall 56 defining a second liner surface 58. A flexible storage unit 50' includes a flexible support 60 with first and second attachment means 62 and 63. Flexible support 60 may be a laminated wire mesh, nylon mesh, or any other similar flexible material. Flexible storage unit 50' includes a load support zone, generally indicated at 66, wherein items 68 and 69 to be refrigerated are supported. The flexible nature of the load support zone 66 allows flexible storage unit 50' to conform to diversely sized and shaped items. In this embodiment, first attachment means 62 connects flexible support 60 directly to first liner surface 54, adjacent planar shelf member 32, while second attachment means 63 is attached directly to second liner surface 58, also adjacent planar shelf member 32. With this arrangement, load support zone 66 is suspended between planar shelf members 31 and 32.

In the embodiment shown in FIG. 3, first attachment means 62 is secured to first liner surface 54 adjacent planar shelf member 32, while second attachment means 63 is secured directly to an underside (not separately labeled) of planar shelf member 32. In this embodiment, load support zone 66 of flexible storage unit 50" is deeper than in the second embodiment, allowing for the support of stacked or tall items.

FIG. 4 depicts a third embodiment in which first attachment means 62 is connected to first liner surface 54 at a position spaced above load support zone 66 of flexible storage unit 50'", but well below planar shelf member 32. In addition, second attachment means 63 is connected to the underside of planar shelf member 32.

Figure 5:
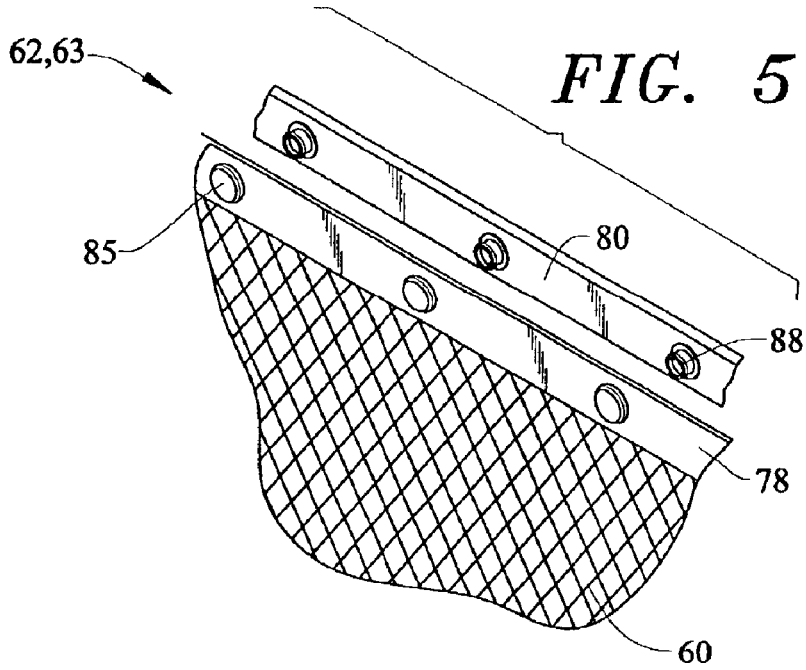
FIG. 5 is a partial view of a snap-type attachment arrangement for the flexible storage unit of the invention.

FIG. 5 illustrates one preferred embodiment of attachment means 62, 63 wherein each attachment means 62, 63 takes the form of a snap connection strip 78, 80. Connection strip 78 is preferably provided with a plurality of spaced female connection elements 85. On the other hand, connection strip 80 is provided with a plurality of correspondingly spaced, male connection elements 88. With this arrangement, flexible storage unit 50, 50', 50", 50'" can be readily, releasably mounted within refrigerator 2. That is, connection strip 80 is fixed within refrigerator 2, such as through the use of an adhesive or mechanical fasteners, and connection strip 78 is releasably attached to connection strip 80. In the alternative, a permanent mounting could be employed. Furthermore, the flexible storage unit 50, 50', 50", 50'" could be collapsible in refrigerator 2, such as by employing one releasable connection and one permanent connection.

Figure 6:
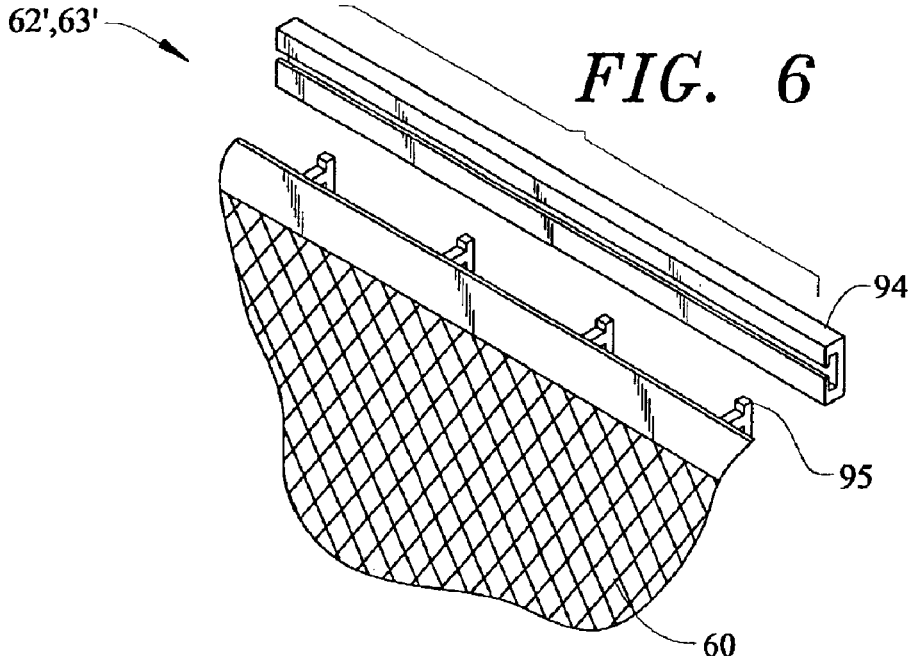
FIG. 6 is a partial view of a track-type attachment arrangement for the flexible storage unit.

It should be noted that, although a snap-type connection is shown in FIG. 5, other methods for attaching flexible storage unit 50, 50', 50", 50'" could be readily employed. For example, attachment means 62, 63 may be in the form of hooks or adjustable tracks. More specifically, FIG. 6 illustrates an embodiment wherein an attachment means 62', 63' is constituted by a track 94, and a plurality of retaining elements 95 define the second attachment means 63'. In this manner, retaining elements 95 are slidably received within track 94.

With the above structure, flexible storage unit 50, 50', 50", 50'" is vertically spaced from each of the first and second planar shelf members 31 and 32, wherein the flexible support 66 varies in shape depending upon the particular items placed thereon. Since each flexible storage unit 50, 50', 50", 50'" can be readily altered in size and shape, storage space in refrigerator 2, which would otherwise be wasted, can be advantageously utilized for additional storage purposes. By making the flexible support 66 from a mesh material, cooling air within the refrigerator 2 can flow through the mesh material and around food items supported thereon, thereby enhancing the overall cooling arrangement.

Although described with reference to preferred embodiments of the invention, it should be readily understood that various changes and/or modifications could be made to the invention without departing from the spirit thereof. For instance, varying types of attachment means, beyond those described above, could be readily utilized. Although shown attached to the wall surfaces of the refrigerator liner in certain embodiments of the invention, it is to be understood that the flexible storage unit of the invention may be attached to other liner portions, whether in the fresh food compartment or the freezer compartment. In general, the invention is only intended to be limited by the scope of the following claims.

I claim:

1. A refrigerator comprising:

a cabinet shell;

a liner mounted in the cabinet shell and defining a refrigeration compartment; and a shelving system for the refrigeration compartment including first and second planar shelf members mounted at vertically spaced positions within the refrigeration compartment for supporting items to be refrigerated; and a flexible storage unit mounted within said refrigeration compartment, said flexible storage unit including a flexible support having a load support zone that is vertically spaced from each of the first and second planar shelf members, wherein the flexible support varies in shape depending upon items placed thereon.

2. The refrigerator according to claim 1, wherein the flexible support is formed of a nylon mesh.

3. The refrigerator according to claim 1, wherein the flexible support is constituted by a laminated wire mesh.

4. The refrigerator according to claim 1, further comprising: attachment means for releasably attaching the flexible storage unit within the refrigeration compartment.

5. The refrigerator according to claim 4, wherein the attachment means defines a snap connection.

6. The refrigerator according to claim 4, wherein the attachment means includes a track.

7. The refrigerator according to claim 4, wherein the attachment means further includes a plurality of retaining elements which are carried by the flexible support and slidably received in the track.

8. The refrigerator according to claim 4, wherein the attachment means supports the flexible storage unit directly from the liner.

9. The refrigerator according to claim 4, wherein the attachment means supports the flexible storage unit directly from the first planar shelf member.

10. In a refrigerator including first and second planar shelf members mounted at vertically spaced positions within a refrigeration compartment defined by a liner positioned within a cabinet shell, a flexible storage unit comprising: a flexible support having a load support zone which is vertically spaced from each of the first and second planar shelf members, wherein the flexible support assumes a shape in conformance with one or more items placed thereon.

11. The flexible storage unit according to claim 10, wherein the flexible support is formed of a nylon mesh.

12. The flexible storage unit according to claim 10, wherein the flexible support is constituted by a laminated wire mesh.

13. The flexible storage unit according to claim 10, further comprising: attachment means for releasably attaching the flexible storage unit within a refrigeration compartment.

14. The flexible storage unit according to claim 13, wherein the attachment means defines a snap connection.

15. The flexible storage unit according to claim 13, wherein the attachment means includes a track.

16. The flexible storage unit according to claim 15, wherein the attachment means further includes a plurality of retaining elements which are carried by the flexible support and slidably received in the track.

17. A method of enabling a plurality of food items to be supported in varying locations within a liner defined refrigeration compartment of a refrigerator comprising:

providing a plurality of vertically spaced shelf members within the refrigeration compartment; and providing a flexible storage unit within the refrigeration compartment, with the flexible storage unit including a flexible support having a load support zone which is vertically spaced from the shelf members, wherein the flexible support varies in shape depending upon items placed thereon.

18. The method of claim 17, further comprising: releasably supporting the flexible storage unit directly from at least one of the shelf members.

19. The method of claim 17, further comprising: releasably supporting the flexible storage unit directly from the liner of the refrigerator.

20. The method of claim 17, further comprising: forming the flexible support from a mesh material, wherein cooling air within the refrigeration compartment can flow through the mesh material and around food items supported thereon.

* * * * *